US005867186A

United States Patent [19]

Teazis

[11] Patent Number: 5,867,186

[45] Date of Patent: Feb. 2, 1999

[54] CAPPING MECHANISM

[75] Inventor: Theofanis P. Teazis, Huntington Beach, Calif.

[73] Assignee: Canon Business Machines, Inc., Costa Mesa, Calif.

[21] Appl. No.: 255,993

[22] Filed: Jun. 8, 1994

[51] Int. Cl.[6] ..... B41J 2/01

[52] U.S. Cl. ..... 347/32

[58] Field of Search ..... 347/29, 87, 32, 347/44, 3

[56] References Cited

U.S. PATENT DOCUMENTS

| | | | |
|---|---|---|---|
| 4,401,990 | 8/1983 | Aiba et al. | 347/44 X |
| 4,500,894 | 2/1985 | Kirner | 347/29 |
| 4,646,111 | 2/1987 | Shimosato et al. | 347/44 X |
| 5,117,244 | 5/1992 | Yu | 347/29 |
| 5,260,724 | 11/1993 | Tomii et al. | 347/32 |
| 5,444,474 | 8/1995 | Ohtsubo et al. | 347/44 X |
| 5,459,496 | 10/1995 | Hanabusa et al. | 347/23 X |

FOREIGN PATENT DOCUMENTS

| | | | |
|---|---|---|---|
| 61-164841 | 7/1986 | Japan | 347/44 |
| 2-258351 | 10/1990 | Japan | 347/44 |
| 5077434 | 4/1993 | Japan | 347/32 |
| 5220967 | 8/1993 | Japan | 347/29 |

*Primary Examiner*—N. Le
*Assistant Examiner*—Craig A. Hallacher
*Attorney, Agent, or Firm*—Fitzpatrick, Cella, Harper & Scinto

[57] ABSTRACT

A capping mechanism for an ink jet print head, both of which are mounted on a carrier for lateral movement on a laterally extending guide rail by a motor controlled by a control device in a direction across a recording medium placed in an ink jet printer. The ink jet print head has a plurality of ink ejection nozzles for forming characters on the recording medium as it laterally moves across the recording medium under the control of the control device in response to the inputting of such characters by a keyboard. The capping mechanism is also mounted for sliding movement relative to the ink ejection nozzles of the ink jet print head between a capped position and an uncapped position. In the capped position, the capping mechanism forms an air tight seal with the ink ejection nozzles. A device, such as mechanical stops or an electromagnet, is also provided to slide the capping mechanism between the capped position and the uncapped position.

10 Claims, 11 Drawing Sheets

CAPPING MECHANISM

BACKGROUND OF THE INVENTION

1. Field of the Invention

The present invention relates to a capping mechanism for an ink jet print head which is mounted for movement with the ink jet print head. More particularly, a capping mechanism according to the present invention is slidably mounted directly on the ink jet print head and is slidable relative to the ink jet print head between a capped position which protects ink ejection nozzles of the ink jet print head and an uncapped position in which the nozzles are uncapped and free to eject ink onto a recording medium.

2. Description of the Related Art

In recent years, ink jet printers have become popular because of their ability to form high quality print images at a low cost. Printers of this type form images by ejecting small droplets of ink through small ink ejection nozzles of the print head as the print head is moved across a recording medium. The ejection of ink droplets is controlled so as to form desired characters, numbers, and symbols on the recording medium.

Because liquid ink is always ready for ejection from the ink ejection nozzles, if printing is not performed for a certain period of time, such as five or ten seconds, the ink may dry sufficiently so as to clog the nozzles. Accordingly, conventional ink jet printers provide a capping mechanism which caps the ink ejection nozzles during quiescent periods when printing is not taking place so as to prevent the nozzles from clogging.

Conventional systems mount the capping mechanism at the left-most end of the print head's travel. However, because a print position indicator is normally attached to the ink jet print head, when the ink jet print head is capped at the left-most end of its travel, the print position indicator cannot indicate the next print position.

Furthermore, because a separate capping mechanism is provided, the size of the printer is unduly increased, and complex control means are needed to coordinate capping of the print head with the operation of the capping mechanism.

Thus, there is a need for a ink jet printer with a simple and compact capping mechanism that permits a print position indicator to indicate the next print position regardless of whether the print head is capped or uncapped.

SUMMARY OF THE INVENTION

The present invention addresses the foregoing situation by providing a capping mechanism for an ink jet print head which is mounted for movement with the ink jet print head and which is slidable relative to the ink jet print head. Suitable means are also provided to slide the capping mechanism between a capped position and an uncapped position.

Thus, according to one aspect of the present invention, an ink jet print head is laterally movable on a laterally extending guide rail by a motor controlled by a control device in a direction across a recording medium placed in the ink jet printer. The ink jet print head has a plurality of ink ejection nozzles for forming characters on the recording medium as it laterally moves across the recording medium in response to the inputting of such characters by a keyboard under the control of the control device. A capping mechanism is also mounted on a carrier for the ink jet print head for lateral movement with the ink jet print head. In one embodiment the capping mechanism is mounted on the same carrier on which the ink jet print head is mounted. The capping mechanism is also mounted for sliding movement relative to the ink ejection nozzles of the ink jet print head between a capped position and an uncapped position. In the capped position, the capping mechanism forms an air tight seal with the ink ejection nozzles. Means are provided to slide the capping mechanism between the capped position and the uncapped position.

In one representative example, the sliding means may include an electromagnet which, when turned on, slides the capping mechanism to the capped position against the force of a spring which biases the capping mechanism into the uncapped position. In another representative example, capping and uncapping stops may be provided on opposite walls of the printer to which the ends of the guide rail are attached. These stops engage respective distal ends of the capping mechanism so as to slide the capping mechanism between the capped and the uncapped position as the ink jet print head is moved to respective ends of the guide rail.

These and other features and advantages of the present invention will be more readily understood by reference to the following detailed description of preferred embodiments taken in conjunction with the attached drawings.

DETAILED DESCRIPTION OF PREFERRED EMBODIMENTS

[I. Structure]

Figure 1:
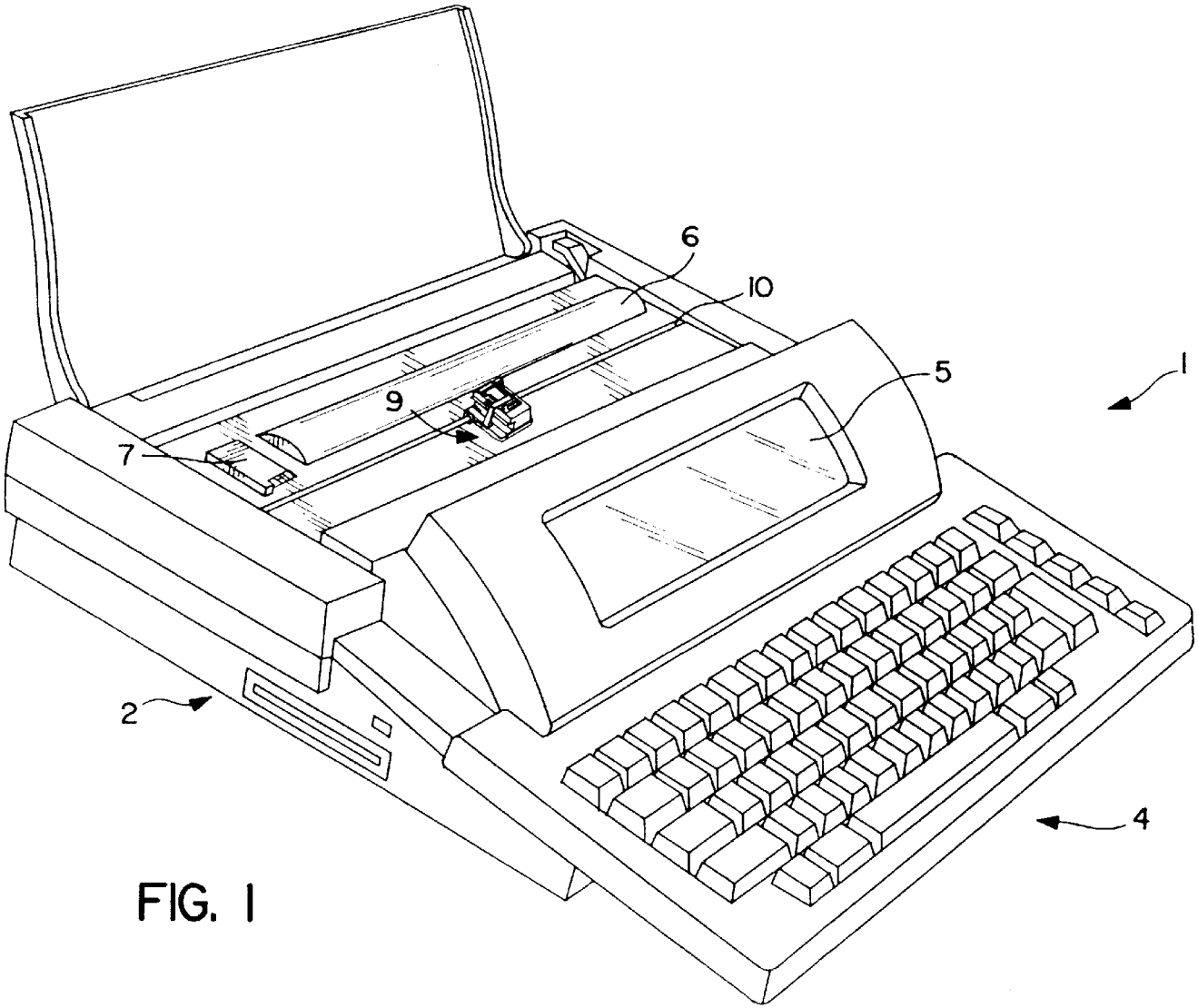
FIG. 1 is a perspective view of a printer embodying the present invention.

As seen in FIG. 1, the present invention is embodied in an ink jet printer 1. The ink jet printer 1 can comprise, for example, Canon Ink Jet Printer Model Number BJ 200 or Canon Ink Jet Printer Model Number BJ 10E. However, it should be understood that the present invention can be applied to any type of printer to which it is desirable to attach a capping mechanism and a position indicator.

The printer 1 comprises a frame 2, an input device such as a keyboard 4, a display screen 5 comprising a liquid crystal display, a platen 6, a stationary capping mechanism 7, a printing and capping assembly 9, and a laterally extending guide rail 10. The frame 2 supports all the other elements of the printer 1.

The keyboard 4 includes character keys, numeral keys, and symbol keys for inputting character data, numeral data, and symbol data, respectively. To simplify the discussion below, characters, numerals, and symbols will all be referred to as "characters" in the plural, and a "character" in the singular.

The keyboard 4 also includes a return key, a space key, and a variety of function keys, as are well known to those skilled in the art. The function keys include keys for selecting the printing mode. With the print mode keys the user can select a character-by-character print mode, in which characters are printed as they are inputted, or a queue print mode, in which characters are not printed until a predetermined number of characters are inputted or until a return is input.

The printing and capping assembly 9 is slidably mounted for lateral movement on the laterally extending guide rail 10 across a recording medium, such as paper (not shown) fed by the platen 6. The ends of the guide rail 10 are attached to opposite walls of the frame 2. The stationary capping mechanism 7 is mounted near the left wall of the frame 2 at a home position, to the left of the left margin of the printer 1. The stationary capping mechanism 7 is configured to engage a portion of the printing and capping assembly 9 in an air tight manner when activated and when the printing and capping assembly 9 is at the home position. The printing and capping assembly 9 is moved to the home position in response to turning off the printer 1 or in response to a software command.

After the printing and capping assembly 9 has printed a line of characters, as will be discussed below, a paper feeding mechanism (not shown) rotates the platen 6 to position the next line of the recording medium directly across from the printing and capping assembly 9 for printing on that line.

Figure 2A:
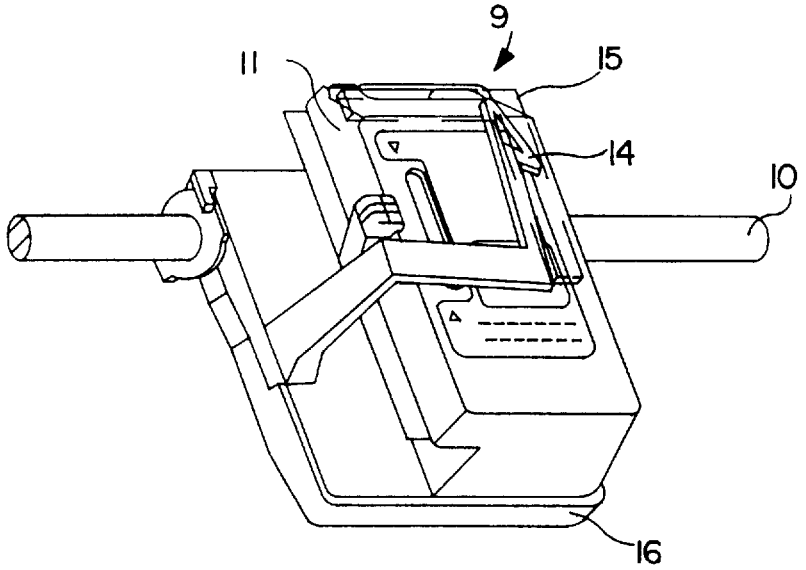
FIGS. 2A and 2B are perspective views of two different embodiments of the position indicator of the present invention.

FIG. 2A shows the printing and capping assembly 9 and the guide rail 10. The printing and capping assembly 9 comprises a print cartridge 11, a print position indicator 14, a slidable capping mechanism 15, and a carrier 16. The carrier 16 supports the print cartridge 11, the print position indicator 14, and the slidable capping mechanism 15, and is configured to slide along the guide rail 10.

The print position indicator 14 is configured and positioned on the carrier 16 to visually indicate the position at which the print cartridge 11 will next print or refrain from printing on the recording medium. Because the print position indicator 14 is supported by the carrier 16, the print position indicator 14 is coupled to the print cartridge 11 so as to move with the print cartridge 11 along the guide rail 10. Thus, as the print cartridge 11 moves laterally along the guide rail 10 printing characters on the recording medium, the print position indicator 14 also moves, thereby continually indicating the next print position. In the embodiment shown in FIG. 2A, the print position indicator 14 comprises an arm located above the print cartridge 11, the end of which has the shape of part of the head of an arrow. This arrow shaped portion of the print position indicator 14 visually indicates the next print position.

Figure 9A:
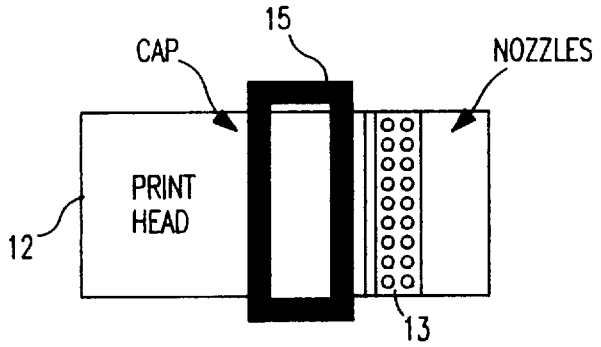
FIG. 9A is a schematic front view of the ink jet print head and the capping mechanism of the present invention.
Figure 9B:
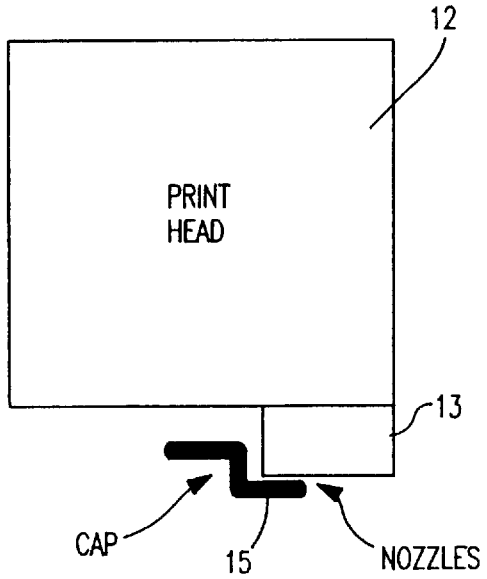
FIG. 9B is a schematic top view of the ink jet print head and the capping mechanism of the present invention.

The slidable capping mechanism 15 is provided to prevent the print cartridge 11 from clogging after the printer 1 is turned on and the print cartridge 11 is not at the home position and is not printing. Because the slidable capping mechanism 15 is mounted on the carrier 16, it laterally moves along the guide rail 10 with the print cartridge 11. Thus, it is available at any time and at any position of the print cartridge 11 along the guide rail 10 to perform its capping function, as will be discussed in more detail below. Thus, the print cartridge 11 need not return to home position to be capped by the stationary capping mechanism 7 after the printer 1 is turned on and is not printing. As a result, the print position indicator 14 can continuously perform its print position indicating function, regardless of whether the print cartridge 11 is capped or uncapped. FIGS. 9A and 9B show top and front schematic views of the capping mechanism 15 and the print head 12.

Figure 2B:
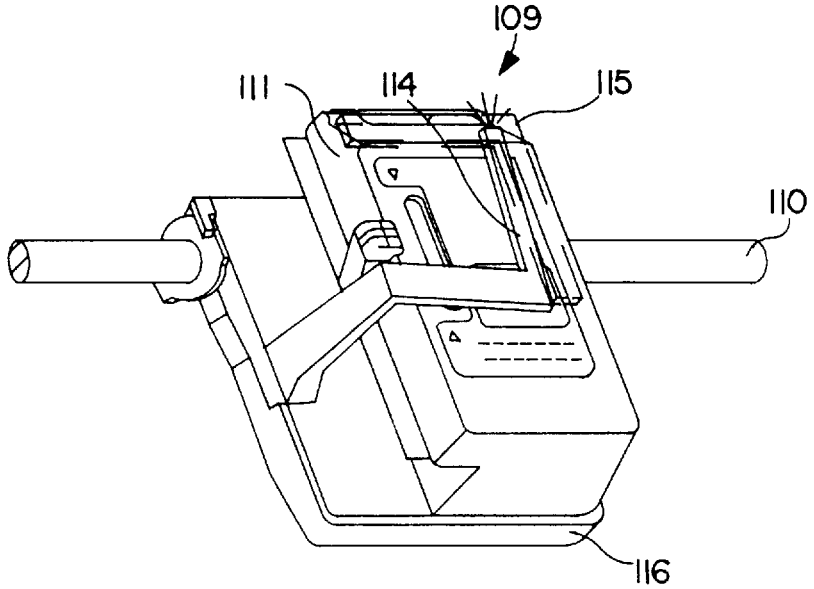

FIG. 2B shows a second embodiment of a portion of the printing and capping assembly. Thus, FIG. 2B illustrates a printing and capping assembly 109 and a guide rail 110. The printing and capping assembly 109 comprises a print cartridge 111, a print position indicator 114, a slidable capping mechanism 115, and a carrier 116. The guide rail 110, the print cartridge 111, the slidable capping mechanism 115, and the carrier 116 are identical to the corresponding elements shown in FIG. 2A. However, the print position indicator 114 is not in the shape of part of the head of an arrow, as shown in FIG. 2A. Rather, the print position indicator 114 comprises a light source for illuminating the next print position.

Figure 3A:
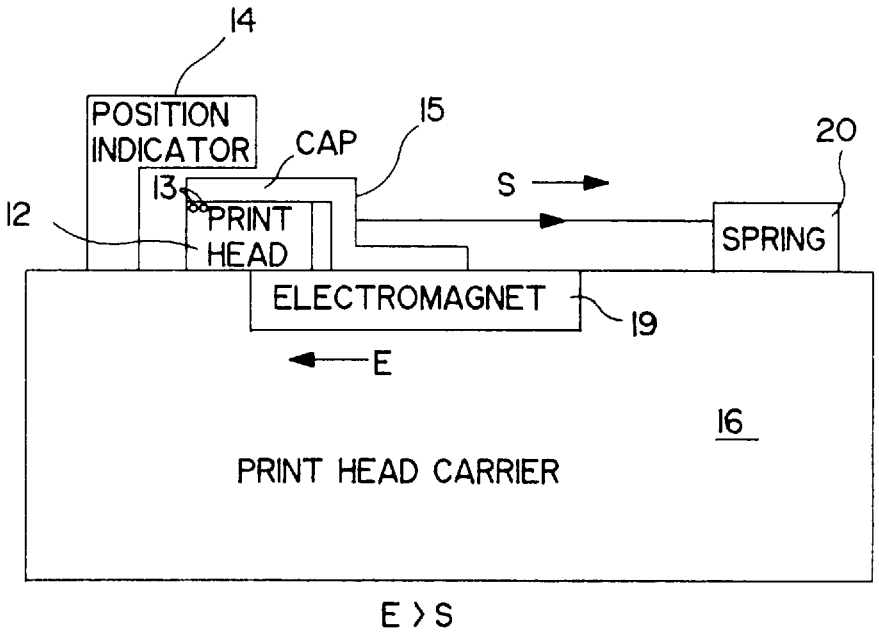
FIGS. 3A and 3B are schematic diagrams illustrating one embodiment of the device for sliding the capping mechanism relative to the ink jet print head.
Figure 3B:
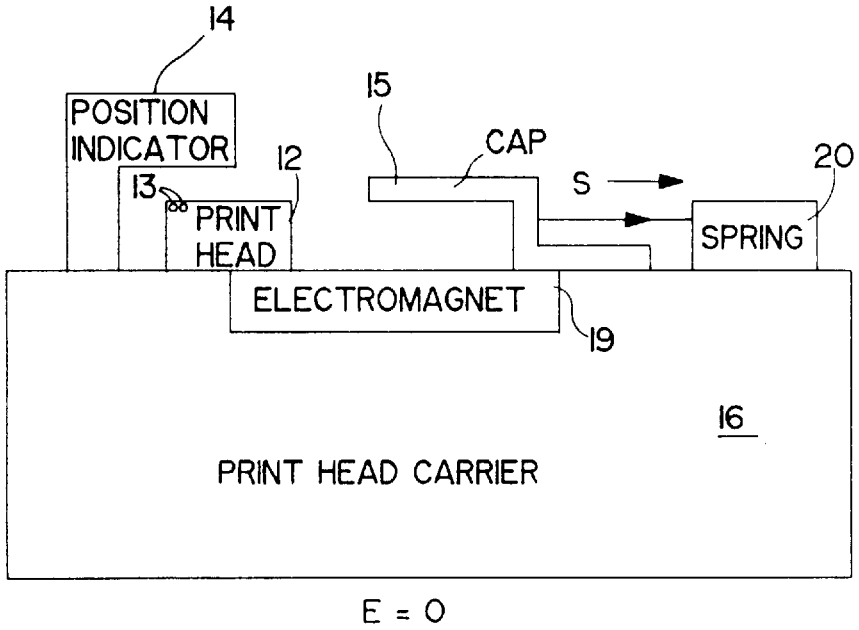

Two embodiments are disclosed for the device controlling the sliding of slidable capping mechanism 15. The first embodiment is shown in FIGS. 3A and 3B. FIG. 3A shows an ink jet print head 12 of the print cartridge 11, and a plurality of ink ejection nozzles 13 of the ink jet print head 12, in addition to the position indicator 14, the slidable capping mechanism 15, and the carrier 16. Ink stored in a reservoir (not shown) of the print cartridge 11 is ejected as ink droplets out of the ink ejection nozzles 13. It should be understood that although only two ink ejection nozzles are shown in FIG. 3A, a larger number of nozzles can be used, as is known to those skilled in the art.

Both the stationary capping mechanism 7 and the slidable capping mechanism 15 are configured to form an air tight seal with the ink ejection nozzles 13 to prevent the clogging thereof when the ink jet print head 12 is not printing. The stationary capping mechanism 7 engages the ink ejection nozzles when the printer is turned off, because when this occurs, the printing and capping assembly 9 moves to the home position. The slidable capping mechanism 15 prevents clogging of the ink ejection nozzles 13 after the printer 1 is turned on, as will now be discussed.

The device for controlling the sliding of the slidable capping mechanism 15 comprises an electromagnet 19 and a spring 20. Both elements are supported by the carrier 16. In this embodiment the slidable capping mechanism 15 or a portion of it is composed at least partially of a material attracted to a magnetic force, as is generated by the electromagnet 19, when the electromagnet 19 is turned on. Such a material can be steel, iron, or an iron containing material.

The electromagnet 19 is positioned so that when turned on, it pulls and slides the slidable capping mechanism 15 relative to the ink jet print head 12 and the ink ejection nozzles 13 to a capped position, shown in FIG. 3A, at which the slidable capping mechanism 15 forms an air tight seal with the ink ejection nozzles 13. In this position, the slidable capping mechanism 15 prevents the ink ejection nozzles 13 from drying out and clogging. This sliding is performed on the carrier 16 against the force of the spring 20, attached to the slidable capping mechanism 15. Sliding of the slidable capping mechanism 15 to the capped position is possible because the force, E, applied by the turned on electromagnet 19 on the slidable capping mechanism 15 is greater than the force, S, applied by the spring 20 on the slidable capping mechanism 15. When the electromagnet 19 is turned off, the spring 20 is configured and positioned to slide the slidable capping mechanism 15 to an uncapped position, spaced from the ink ejection nozzles 13, as shown in FIG. 3B. When the slidable capping mechanism 15 is at the uncapped position, the ink jet print head 12 can print.

Figure 4A:
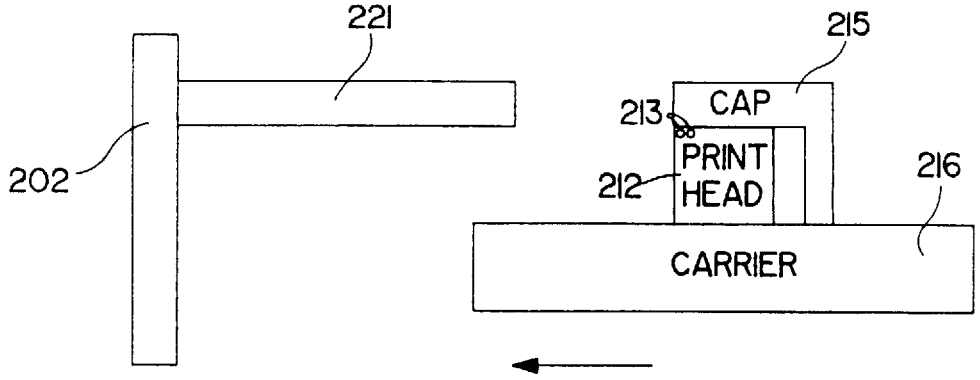
FIGS. 4A through 4J are schematic diagrams of an alternative embodiment of the device for sliding the capping mechanism relative to the ink jet print head.
Figure 4B:
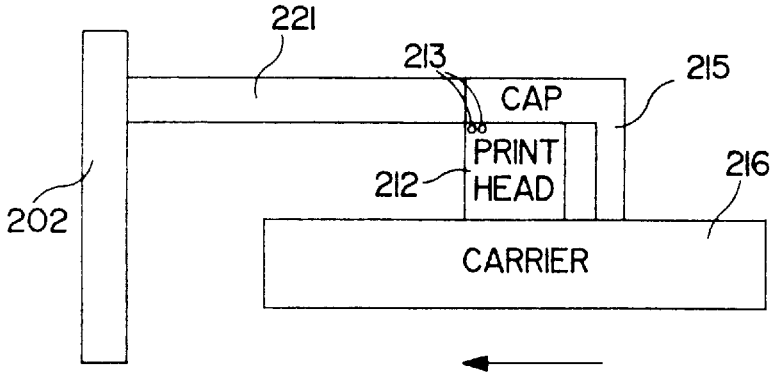
Figure 4C:
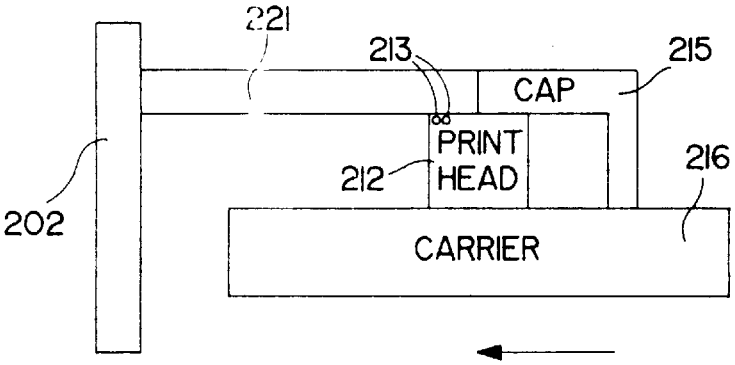
Figure 4D:
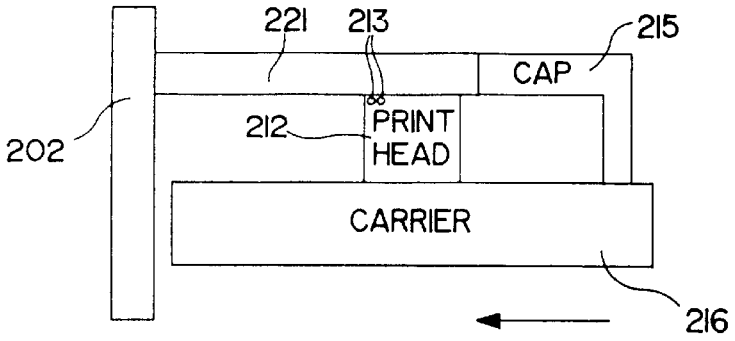
Figure 4E:
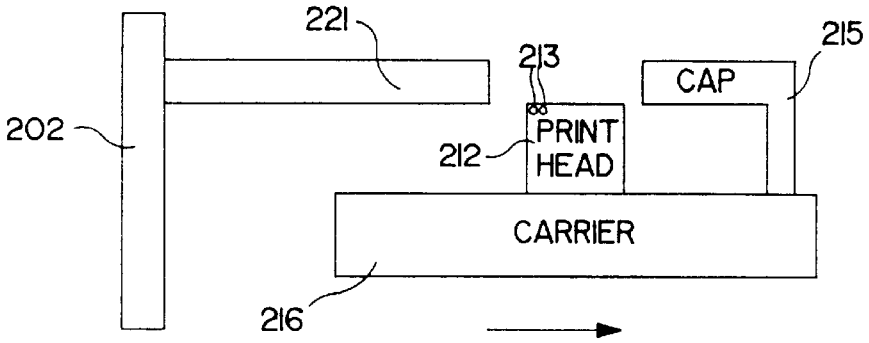
Figure 4F:
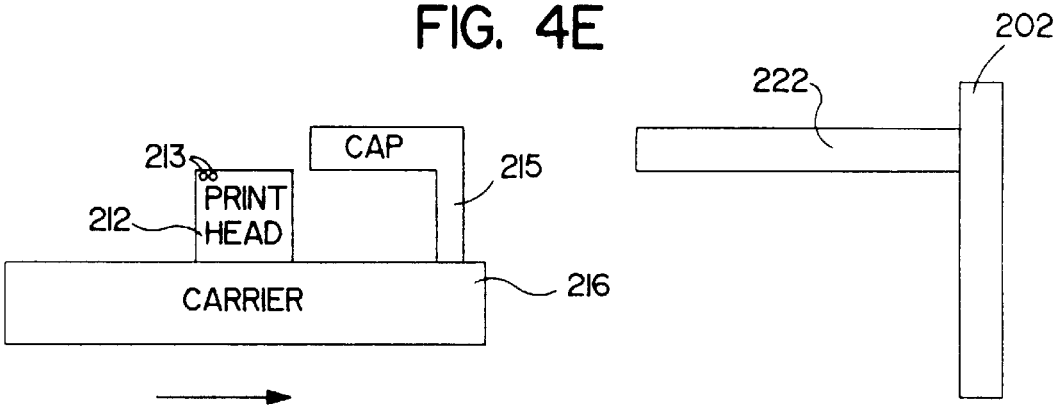
Figure 4G:
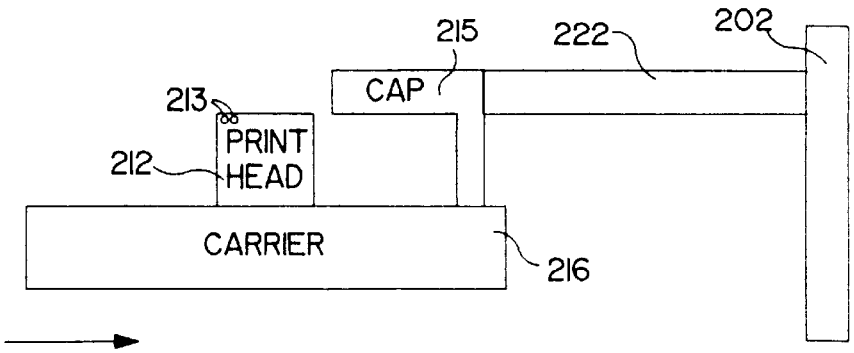
Figure 4H:
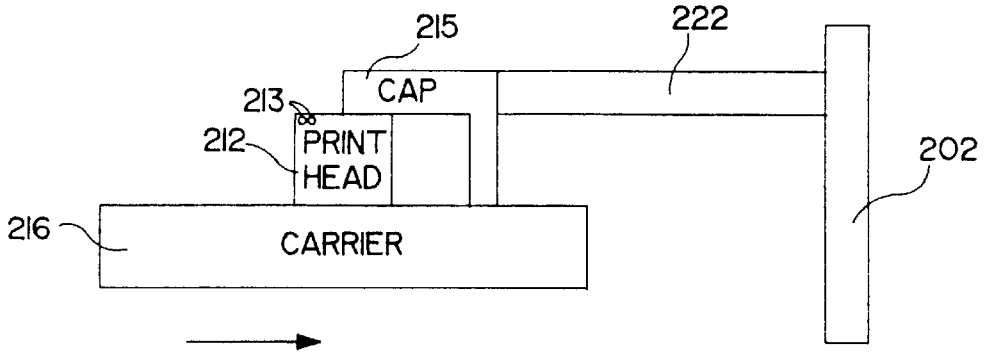
Figure 4I:
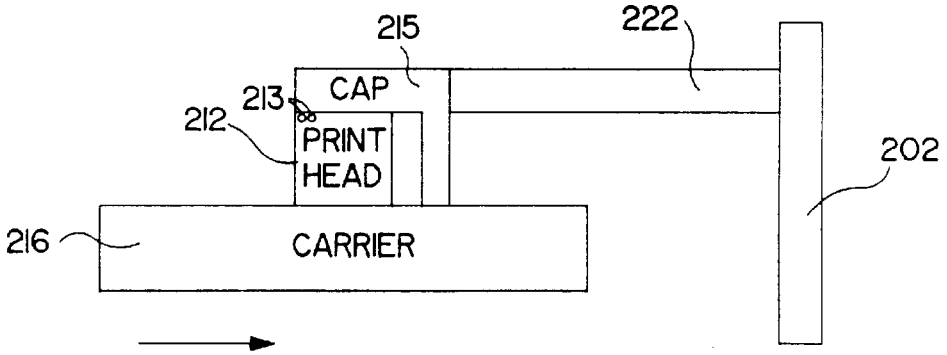
Figure 4J:
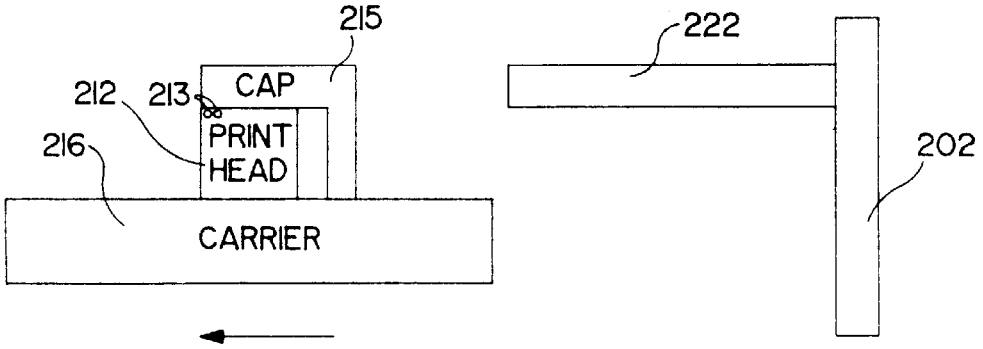

The second embodiment of the device for controlling the sliding of the slidable capping mechanism 15 is shown in FIGS. 4A through 4J. Accordingly, FIG. 4A shows a left wall of the frame 202 of the printer, an ink jet print head 212, a slidable capping mechanism 215, and a carrier 216. These elements are identical to the corresponding elements shown in FIGS. 1, 3A and 3B, except for the frame 202. On the left wall of the frame 202 is mounted an uncapping stop 221. FIGS. 4B through 4E also show these elements. FIG. 4F shows the right wall of the frame 202, the ink jet print head 212, the slidable capping mechanism 215, the carrier 216, and a capping stop 222. The capping stop 222 is mounted on the right wall of the frame 202. FIGS. 4G through 4I show the same elements illustrated in FIG. 4F.

The uncapping stop 221 and the capping stop 222 constitute the second embodiment of the device for controlling the sliding of the slidable capping mechanism 15. More specifically, the uncapping stop 221 is configured and positioned so as to engage the left distal end of the slidable capping mechanism 15 and to push and slide the slidable capping mechanism 15 from the capped position to the uncapped position when the carrier 216 moves to a leftmost position before the stationary capping mechanism 7 and between the stationary capping mechanism 7 and the left end of the platen 6 on the guide rail 10, as shown in FIGS. 3A through 3D. The capping stop 222 is configured and positioned so as to engage the right distal end of the slidable capping mechanism 15 and to push and slide the slidable capping mechanism 15 from the uncapped position to the capped position, when the carrier 216 moves to its rightmost position on the guide rail 10, as shown in FIGS. 3E through 3I.

Figure 5A:
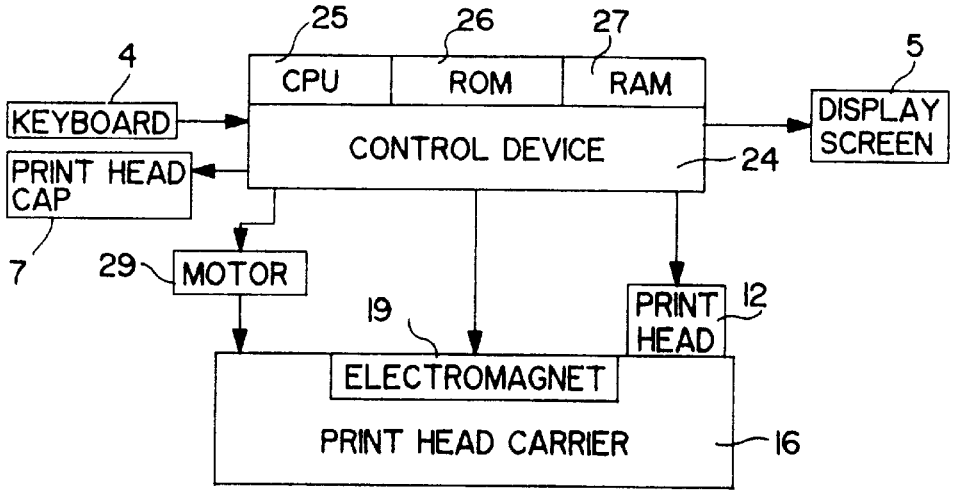
FIGS. 5A, 5B, and 5C are schematic block diagrams of the control device of the present invention used with different embodiments of the device for sliding the capping mechanism and the print position indicator.

FIG. 5A shows the control structure and other elements used with the embodiment shown in FIGS. 2A, 3A, and 3B. More specifically, FIG. 5A shows the keyboard 4, the display screen 5, the stationary capping mechanism 7, the print head cap 12, the carrier 16, and the electromagnet 19 all connected to a control device 24. The control device 24 comprises a central processing unit (CPU) 25, a read only memory (ROM) 26, and a random access memory (RAM) 27. In addition, a motor 29 is connected to the control device 24 and to the carrier 16.

The CPU 25 operates according to programs stored in the ROM 26. The RAM 27 stores various types of information including data inputted by the keyboard 4.

The CPU 25 controls the actuation of the motor 29, which in turn, controls the movement of the carrier 16 along the guide rail 10. In addition, the CPU 25 controls the other functions of the printer 1. These other functions include actuating the stationary capping mechanism 7, turning on and off the electromagnet 19, receiving and processing input data from the keyboard 4, controlling the displaying of input data on the display screen 5, controlling the printing operations of the ink jet print head 12, controlling the selection of the print mode, and controlling the paper feed mechanism to feed paper at the appropriate times with the platen 10.

Figure 5B:
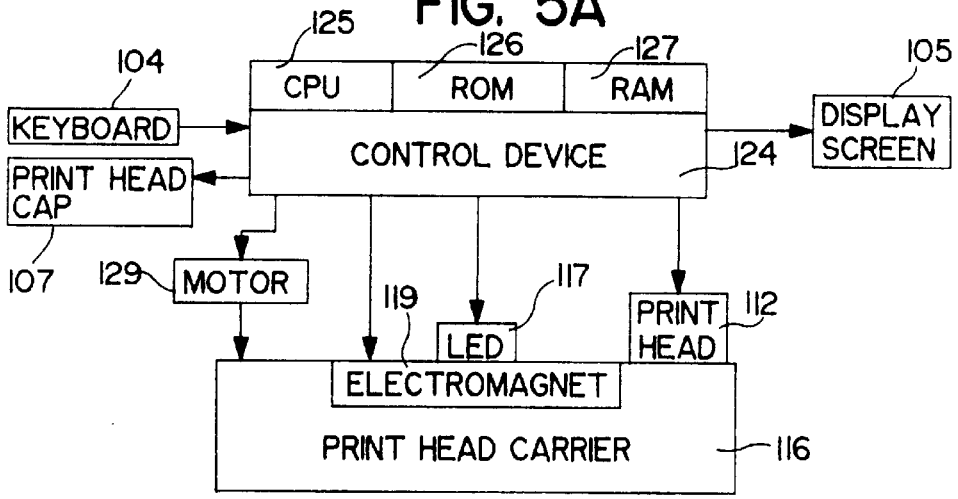

FIG. 5B shows the control structure and other elements that are used with the embodiment shown in FIG. 2B. More specifically, FIG. 5B shows a keyboard 104, a display screen 105, a stationary capping mechanism 107, an ink jet print head 112, a carrier 116, a light emitting diode 117 of the print position indicator 114, and an electromagnet 119, all connected to a control device 124. The control device 124 comprises a central processing unit (CPU) 125, a read only memory (ROM) 126, and a random access memory (RAM) 127. In addition, a motor 129 is connected to the control device 124 and to the carrier 116.

The structure and function of the keyboard 104, the display screen 105, the stationary capping mechanism 107, the ink jet print head 112, the carrier 116, the electromagnet 119, the control device 124, the CPU 125, the ROM 126, the RAM 127, and the motor 129 are the same as the corresponding elements shown in FIG. 5A, except that the CPU 125 controls the illumination of the light emitting diode 117 of the print position indicator 114.

Figure 5C:
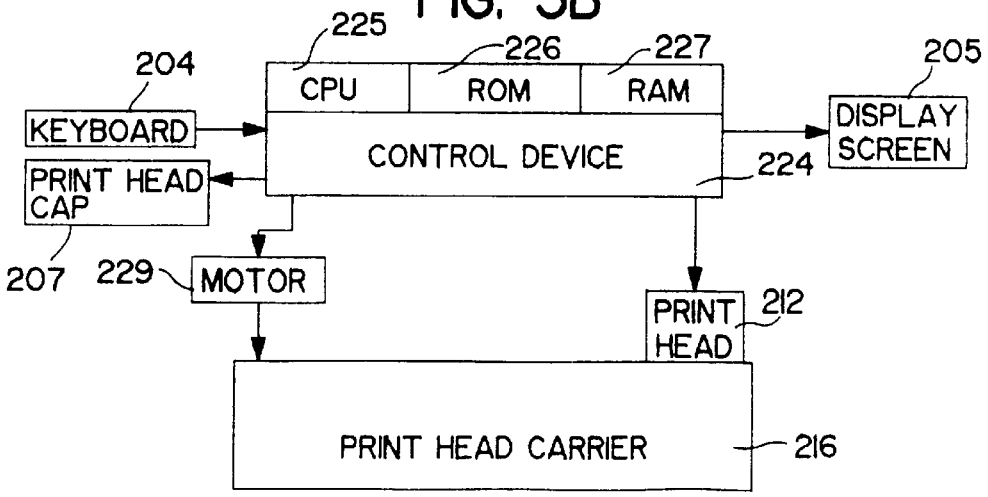

FIG. 5C shows the control structure and other elements that are used with the embodiment shown in FIGS. 4A through 4J. More specifically, FIG. 5C shows a keyboard 204, a display screen 205, a stationary capping mechanism 207, an ink jet print head 212, and a carrier 216, all connected to a control device 224. The control device 224 comprises a central processing unit (CPU) 225, a read only memory (ROM) 226, and a random access memory (RAM) 227. In addition, a motor 229 is connected to the control device 224 and to the carrier 216.

The structure and function of the keyboard 204, the display screen 205, the stationary capping mechanism 207, the ink jet print head 212, the carrier 216, the control device 224, the CPU 225, the ROM 226, the RAM 227, and the motor 229 are the same as the corresponding elements shown in FIG. 5A, except that some of the programs stored in the ROM 226 differ from those stored in the ROM 26. This is because the ROM 226 stores a program for controlling the sliding of the slidable capping mechanism 15 that requires the carrier 216 to move to its farthest right and left positions in order to cap and uncap the ink jet print head 12. Such movement is not required for the FIG. 5A embodiment.

[II. Operation]

Three specific embodiments of the method of the present invention are discussed below. These embodiments have the following common features. When a character is input by the keyboard, the CPU instructs the motor to move the printing and capping assembly and therefore, the print head to the right. In the character-by-character print mode, when a character is input, the CPU also instructs the print head to print the input character as it moves over the next print position before the next character is input. If a space is input, the CPU instructs the motor to move to the print head to the right and instructs the print head to do so without printing. As more characters and spaces are input, the print head moves further to the right. If the number of spaces and characters that are input exceeds a predetermined number, the print head will move to the right margin. At this point, two alternative methods can be performed. In one variation, the print head will not move when it arrives at the right margin, but awaits the input of a return. When a return is input, a line feed operation is performed by rotating the platen and the print head is returned to the left margin to print the next line. Alternatively, the CPU automatically instructs the performing of the line feed operation and returns the print head to the left margin.

The three embodiments of the method of the present invention shown in FIGS. 6, 7, and 8 and discussed below use this alternative variation. However, it should be understood that each of the methods illustrated in FIGS. 6, 7 and 8 can be practiced without this automatic line feed and return feature.

[A. Using An Electromagnet in a Character-By-Character Print Mode]

Figure 6:
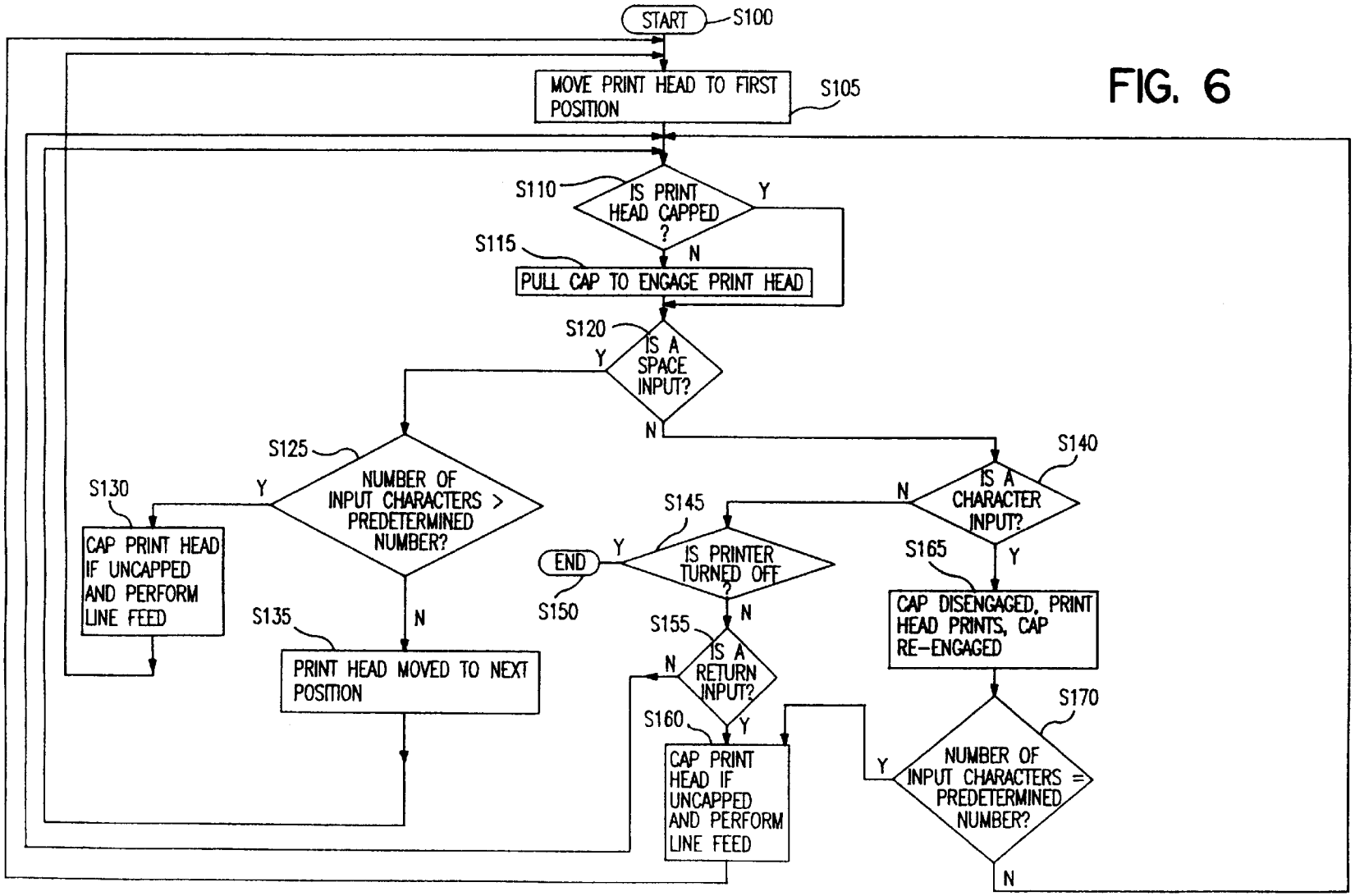
FIG. 6 is a flow chart illustrating a first embodiment of the method of the present invention.

FIG. 6 shows a first embodiment of the method of the present invention. In this embodiment, the device for sliding the slidable capping mechanism 15 comprises the electromagnet 19 and the spring 20 shown in FIGS. 3A and 3B. Moreover, the printer 1 is set to operate in the character-by-character print mode. In this mode, the CPU 25 instructs the motor 29 to move print head 12 to the right and instructs the ink jet print head 12 to print each time a character is input and before the next character is input.

In step S100, the printer 1 is turned on. Prior to being turned on, the ink jet print head 12 is located at the home position and is capped by the stationary capping mechanism 7. After the printer 1 is turned on, the CPU 25 instructs the motor 29 to move the printing and capping assembly 9 from the home position to the beginning of a first print position at the left margin in step S105. When this occurs, the print position indicator 14, which is part of the printing and capping assembly 9, indicates the first print position, also in step S105. Next, the CPU 25 determines whether the ink jet print head 12 is capped in step S110. This can be accomplished, for example, by the CPU 25 checking an internal flag or receiving a signal from a sensor (not shown). If not capped, the CPU 25 turns on the electromagnet 19, which moves the slidable capping mechanism 15 from the uncapped position to the capped position to cap the ink jet print head 12 in step S115. The method then advances to step S120. If the CPU 25 determines that the ink jet print head 12 is capped in step S110, the method also advances to step S120. In step S120 the CPU 25 determines whether a space is input by the keyboard 4. If the CPU 25 determines that a space is input, the CPU 25 determines whether the number of input spaces and characters exceeds a predetermined number needed to move the ink jet print head 12 and the printing and capping assembly 9 to the right margin in step S125.

If the number of input characters and spaces does not exceed the predetermined number needed to move the ink jet print head 12 to the right margin, the method advances to step S135. In step S135, the CPU 25 instructs the ink jet print head 12 to refrain from printing, the CPU 25 maintains the electromagnet 19 turned on, to maintain the slidable capping mechanism 15 in the capped position, and the CPU 25 instructs the motor 29 to move the ink jet print head 12 to the right to the beginning of the next print position. As a result, the print position indicator 14 will indicate the next print position. The method then returns to step S110 to determine whether the ink jet print head 12 is capped and to await the inputting of additional characters and spaces. When additional characters and spaces are input, the ink jet print head 12 is moved further to the right. Eventually, a sufficient number of characters and spaces are input by the keyboard 4 for the CPU 25 in step S125 to determine that the number of input characters and spaces exceeds the predetermined number needed to move the ink jet print head 12 to the right margin.

If it does, this means that an entire line has been printed. As a result, the method advances to step S130 where the ink jet print head 12 is capped if it is uncapped (by the CPU 25 determining whether the ink jet print head 12 is capped and turning on the electromagnet 19 if it is not) and the CPU 25 instructs the performing of a line feed operation. The method then returns to step S105, so that the ink jet print head 12 is returned to the left margin for printing of the next line.

If the CPU 25 determines in step S120 that a space is not input, the method advances to step S140. In step S140, the CPU 25 determines whether a character is input. If the CPU 25 determines that a character is not input, the CPU 25 then determines whether the printer 1 is turned off in step S145. If the CPU 25 determines that the printer 1 is turned off, the CPU 25 instructs the motor 29 to move the ink jet print head 12 to the home position to be capped by the stationary capping mechanism 7 and the method is ended at step S150. This procedure prevents the ink jet print head 12 from drying out when the printer 1 is turned off.

If the CPU 25 determines in step S145 that the printer 1 is not turned off, the method advances to step S155, where the CPU 25 determines whether a return is input by the keyboard 4. If a return is not input, the method returns to step S110. If a return is input, the method advances to step S160. In step S160 the ink jet print head 12 is capped if it is uncapped and the CPU 25 instructs the performing of a line feed operation. The method then returns to step S105, so that the ink print head 12 is returned to the left margin for printing of the next line.

On the other hand, if the CPU 25 determines in step S140 that a character is input, the method advances to step S165 in which the CPU 25 turns off the electromagnet 19. As a result, the spring 20 pulls the slidable capping mechanism 15 from the capped position to the uncapped position. The CPU 25 then instructs the ink jet print head 12 to print the input character. Next, the CPU 25 turns on the electromagnet 19, thereby pulling the slidable capping mechanism 15 from the uncapped position to the capped position. Because the ink jet print head 12 has moved across the first print position to print the input character, the print position indicator 14 now indicates the next print position. The method then advances to step S170 where the CPU 25 then determines whether the number of input spaces and characters exceeds a predetermined number needed to move the ink jet print head 12 and the printing and capping assembly 9 to the right margin. If it does, this means that an entire line has been printed. As a result, the method advances to step S160 where the ink jet print head 12 is capped if it is uncapped and the CPU 25 instructs the performing of a line feed operation. The method then returns to step S105, so that the ink jet print head 12 is returned to the left margin for printing of the next line.

If the CPU 25 determines in step S170 that the number of input spaces and characters does not exceed a predetermined number needed to move the ink jet print head 12 to the right margin, the method then returns to step S110 to confirm the capping of the ink jet print head 12 and to await the inputting of additional spaces and characters.

[B. Using An Electromagnet in a Queue Print Mode]

Figure 7:
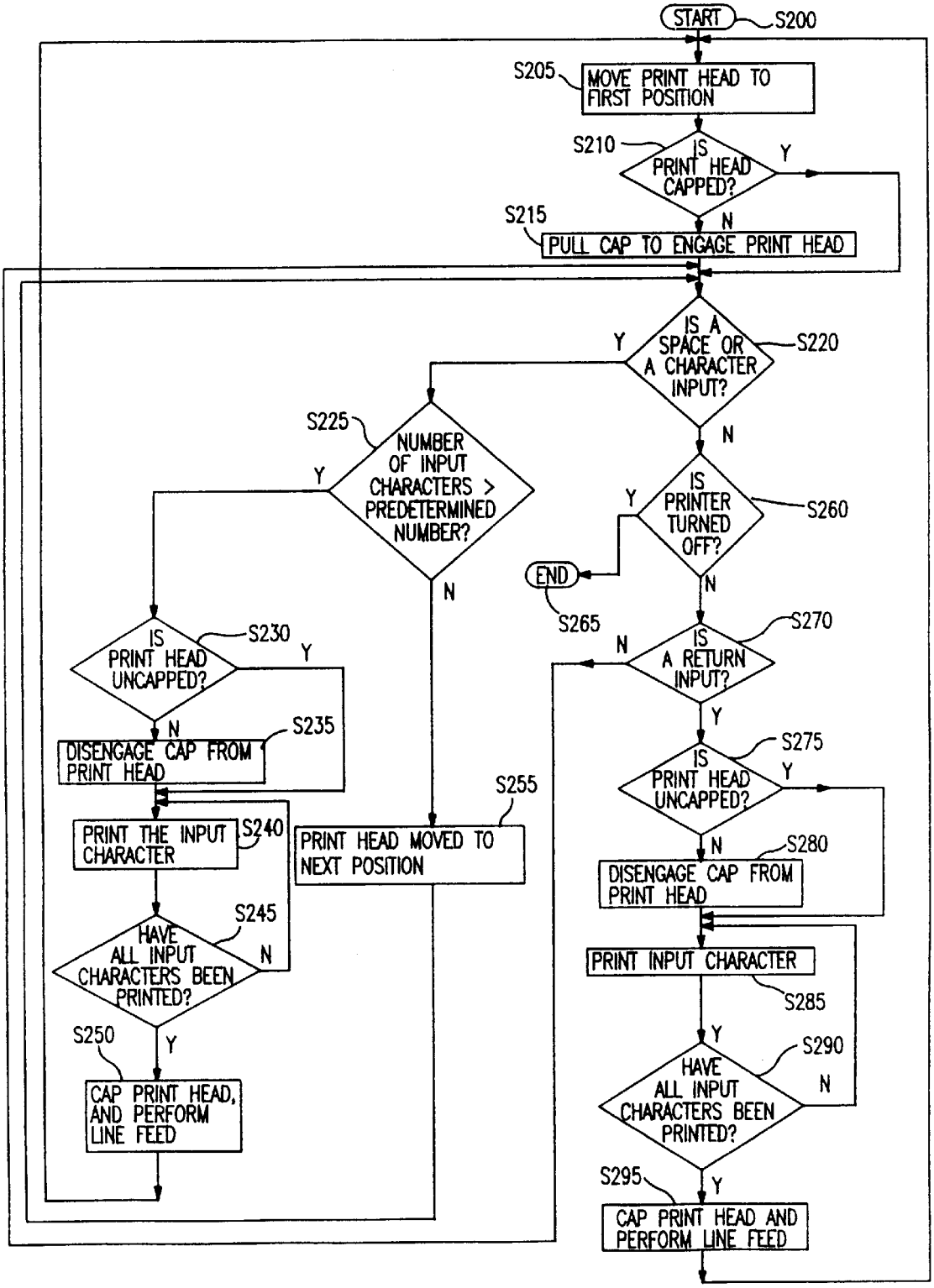
FIG. 7 is a flow chart illustrating a second embodiment of the method of the present invention.

FIG. 7 shows a second embodiment of the method of the present invention. In this embodiment, the device for sliding the slidable capping mechanism also comprises the electromagnet 19 and the spring 20 shown in FIGS. 3A and 3B. In addition, the printer 1 is set to operate in the queue print mode. In this mode, the CPU 25 instructs the motor 29 to move the ink jet print head 12 to the right and instructs the ink jet print head 12 to refrain from printing each time a character is input, until a return is input or the number of input characters and spaces exceeds the predetermined number needed to move the ink jet print head 12 to the right margin. Once a return is input or the number of input characters and spaces exceeds the predetermined number needed to move the ink jet print head 12 to the right margin, the CPU 25, in response thereto, instructs the motor 29 to return the ink jet print head 12 to the left margin, and to move to the right to a plurality of print positions and instructs the ink jet print head 12 to print the input characters while moving to the plurality of print positions.

In step S200, the printer 1 is turned on. Prior to being turned on, the ink jet print head 12 is located at the home position and is capped by the stationary capping mechanism 7. After the printer 1 is turned on, the CPU 25 instructs the motor 29 to move the printing and capping assembly 9 from the home position to the beginning of a first print position at the left margin in step S205. When this occurs, the print position indicator 14, which is part of the printing and capping assembly 9, indicates the first print position, also in step S205. Next, the CPU 25 determines whether the ink jet print head 12 is capped in step S210. If it is not capped, the CPU 25 turns on the electromagnet 19, which moves the slidable capping mechanism 15 from the uncapped position to the capped position in step S215. The method then advances to step S220. If the CPU 25 determines that the ink jet print head 12 is capped in step S210, the method also advances to step S220.

In step S220 the CPU 25 determines whether a space or a character is input by the keyboard 4. If the CPU 25 determines that a space or a character is input, the CPU 25 determines whether the number of input spaces and characters exceeds a predetermined number needed to move the ink jet print head 12 and the printing and capping assembly 9 to the right margin in step S225. If the number of input characters and spaces does not exceed the predetermined number needed to move the ink jet print head 12 to the right margin, the method advances to step S255. In step S255, the CPU 25 instructs the ink jet print head 12 to refrain from printing, the CPU 25 maintains the electromagnet 19 turned on to maintain the slidable capping mechanism 15 in the capped position, and the CPU 25 instructs the motor 29 to move the ink jet print head 12 to the right to the beginning of the next print position. As a result, the print position indicator 14 will indicate the next print position. The method then returns to step S220 to await the inputting of additional characters and spaces. When additional characters and spaces are input, the ink jet print head 12 is moved further to the right while being capped and while refraining from printing. Eventually, a sufficient number of characters and spaces are input by the keyboard 4 for the CPU 25 in step S225 to determine that the number of input characters and spaces exceeds the predetermined number needed to move the ink jet print head 12 to the right margin. If it does, this means that an entire line has been input. As a result, the method advances to step S230.

In step S230, the CPU 25 determines whether the ink jet print head 12 is uncapped. If it is uncapped, the method advances to step S240. If it is not uncapped, the CPU 25 turns off the electromagnet 19 in step S235. As a result, the spring 20 pulls the slidable capping mechanism 15 from the capped position to the uncapped position also in step S235. The method then also advances to step S240. In step S240 the CPU 25 instructs the motor 29 to move the ink jet print head 12 to the first print position at the left margin and then to the right to a plurality of print positions and eventually to the right margin. While moving across the first print position and the plurality of print positions, the CPU 25 instructs the ink jet print head 12 to print the input characters and leave the input spaces, also in step S240.

The CPU 25 next determines whether all the input characters have been printed and whether all the input spaces have been left in step S245. If not, the method returns to step S240. If the CPU 25 determines in step S245 that all the input characters have been printed and all the input spaces have been left, the method advances to step S250. In step S250 the CPU 25 turns on the electromagnet 19, thereby pulling the slidable capping mechanism 15 from the uncapped position to the capped position and instructs the performing of a line feed operation. The method then returns to step S200 where the ink jet print head 12 is moved to the first print position to await the inputting of characters and spaces to be printed on the next line.

If the CPU 25 determines that a character or a space are not input at step S220, the method advances to step S260, where the CPU 25 determines whether the printer 1 is turned off. If it is, the CPU 25 instructs the motor 29 to move the ink jet print head 12 to the home position to be capped by the stationary capping mechanism 7. If not, the method advances to step S270, where the CPU 25 determines whether a return is input by the keyboard 4. If it is not, the method returns to step S220 to await the inputting of additional characters and spaces. If it is, the method advances to step S275, where the CPU 25 determines whether the ink jet print head 12 is uncapped. If it is, the method proceeds to step S285. If not, the method advances to step S280 where the CPU 25 turns off the electromagnet 19, so that the spring 20 pulls the slidable capping mechanism 15 from the capped position to the uncapped position. The method then advances to step S285.

In step S285 the CPU 25 instructs the motor 29 to move the ink jet print head 12 to the first print position at the left margin and then to the right to a plurality of print positions and eventually to the right margin. While moving across the first print position and the plurality of print positions, the CPU 25 instructs the ink jet print head 12 to print the input characters and leave the input spaces, also in step S285. The CPU 25 next determines whether all the input characters have been printed and whether all the input spaces have been left in step S290. If not, the method returns to step S285. If the CPU 25 determines in step S290 that all the input characters have been printed and all the input spaces have been left, the method advances to step S295. In step S295 the CPU 25 turns on the electromagnet 19, thereby pulling the slidable capping mechanism 15 from the uncapped position to the capped position, and instructs the performing of a line feed operation. The method then returns to step S200 where the ink jet print head 12 is moved to the first print position to await the inputting of characters and spaces to be printed on the next line.

[C. Using Capping and Uncapping Stops in a Queue Print Mode]

Figure 8:
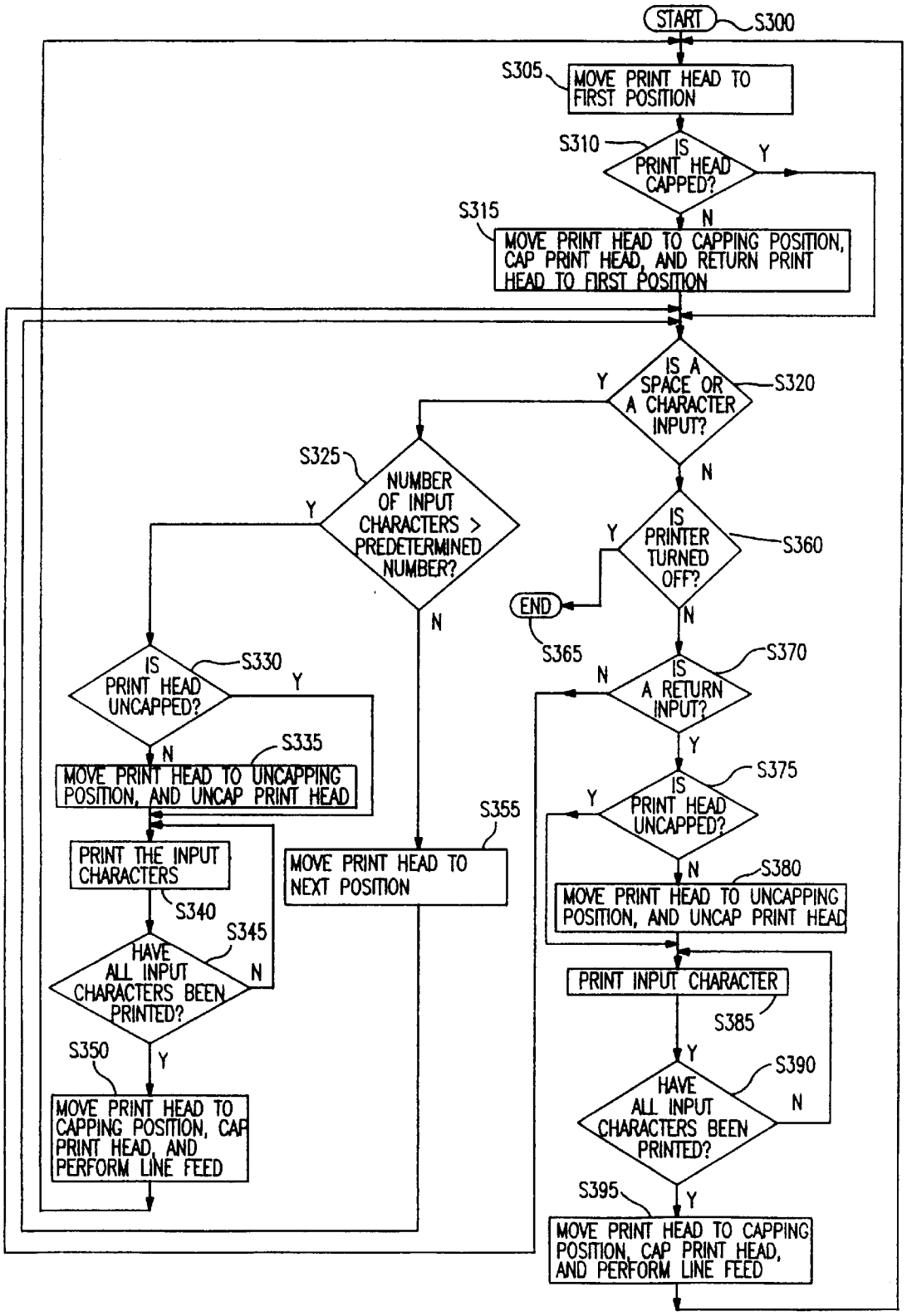
FIG. 8 is a flow chart illustrating a third embodiment of the method of the present invention.

FIG. 8 shows a third embodiment of the method of the present invention. In this embodiment, the device for sliding the slidable capping mechanism comprises the uncapping stop 121 and the capping stop 122. In addition, the printer is set to operate in the queue print mode described above.

In step S300, the printer is turned on. Prior to being turned on, the print head 212 is located at the home position and is capped by the stationary capping mechanism 207. After the printer is turned on, the CPU 225 instructs the motor 229 to move the carrier 216 from the home position to the beginning of a first print position at the left margin in step S305. When this occurs, the position indicator attached to the carrier 216 indicates the first print position, also in step S305. Next, the CPU 225 determines whether the ink jet print head 212 is capped in step S310. If it is not capped, the CPU 225 instructs the motor 229 to move the ink jet print head 212 to the capping stop 222. This movement of the ink jet print head 212 to the capping stop 222 is seen in FIG. 4G. Next, as seen in FIGS. 4H and 4I, the CPU 225 instructs the motor 229 to move the carrier 216 further to the right to its farthest right position so that the capping stop 222 pushes the slidable capping mechanism 215 from the uncapped position to the capped position. The CPU 225 then instructs the motor 229 to return the ink jet print head 212 to the first print position. The method then advances to step S320. If the CPU 225 determines that the ink jet print head 212 is capped in step S310, the method also advances to step S320.

In step S320, the CPU 225 determines whether a space or a character is input by the keyboard 214. If the CPU 225 determines that a space or a character is input, the CPU 225 determines whether the number of input spaces and characters exceeds a predetermined number needed to move the ink jet print head 212 and the carrier 216 to the right margin in step S325. If the number of input characters and spaces does not exceed the predetermined number needed to move the ink jet print head 212 to the right margin, the method advances to step S355. In step S355, the CPU 225 instructs the ink jet print head 212 to refrain from printing, the slidable capping mechanism 215 is maintained in the capped position, and the CPU 225 instructs the motor 229 to move the ink jet print head 212 to the right to the beginning of the next print position. As a result, the print position attached to the carrier 216 will indicate the next print position. The method then returns to step S320 to await the inputting of additional characters and spaces. When additional characters and spaces are input, the ink jet print head 212 is moved further to the right while being capped and while refraining from printing. Eventually, a sufficient number of characters and spaces are input by the keyboard 204 for the CPU 225 in step S325 to determine that the number of input characters and spaces exceeds the predetermined number needed to move the ink jet print head 212 to the right margin. If it does, this means that an entire line has been inputted. As a result, the method advances to step S330.

In step S330, the CPU 225 determines whether the ink jet print head 212 is uncapped. If it is uncapped, the method advances to step S340. If it is not uncapped, the method advances to step S335 where the CPU 225 instructs the motor 229 to move the ink jet print head 212 and the print head carrier 216 to the left to the uncapping stop 221 so that the left distal end of the slidable capping mechanism 215 engages the uncapping stop 221, as shown in FIG. 4B. The CPU 225 then instructs the motor 229 to continue moving the carrier 216 to the left to its farthest left position so that the uncapping stop 221 pushes the slidable capping mechanism 215 to the uncapped position, as seen in FIGS. 4C, 4D, and 4E. After this occurs, the method advances to step S340.

In step S340 the CPU 225 instructs the motor 229 to return the ink jet print head 212 to the first print position at the left margin and then to the right to a plurality of print positions and eventually to the right margin. While moving across the first print position and the plurality of print positions, the CPU 225 instructs the ink jet print head 212 to print the input characters and leave the input spaces, also in step S340.

The CPU 225 next determines whether all the input characters have been printed and whether all the input spaces have been left in step S345. If not, the method returns to step S340. If the CPU 225 determines in step S345 that all the input characters have been printed and all the input spaces have been left, the method advances to step S350. In step S350 the CPU 225 instructs the motor 229 to move the ink jet print head 212 to the capping stop 221 to cap the ink jet print head 212 with the slidable capping mechanism 215 as discussed above, and then instructs the performing of a line feed operation. The method then returns to step S300 where the ink jet print head 212 is moved to the first print position to await the inputting of characters and spaces to be printed on the next line.

If the CPU 225 determines that a character or a space are not input at step S320, the method advances to step S360, where the CPU 225 determines whether the printer is turned off. If it is, the CPU 225 instructs the motor 229 to move the ink jet print head 212 to the home position to be capped by the stationary capping mechanism 207. If not, the method advances to step S370, where the CPU 225 determines whether a return is input by the keyboard 204. If it is not, the method returns to step S320 to await the inputting of additional characters and spaces. If it is, the method advances to step S375, where the CPU 225 determines whether the ink jet print head 212 is uncapped. If it is, the method proceeds to step S385. If not, the method advances to step S380 where the CPU 225 instructs the motor 229 to move the ink jet print head 212 to the uncapping stop 221 to uncap the ink jet print head 212 by moving the slidable capping mechanism 215 to the uncapped position as discussed above. The method then advances to step S385.

In step S385 the CPU 225 instructs the motor 229 to move the ink jet print head 212 to the first print position at the left margin and then to the right to a plurality of print positions and eventually to the right margin. While moving across the first print position and the plurality of print positions, the CPU 225 instructs the ink jet print head 212 to print the input characters and leave the input spaces, also in step S385. The CPU 225 next determines whether all the input characters have been printed and whether all the input spaces have been left in step S390. If not, the method returns to step S385. If the CPU 225 determines in step S390 that all the input characters have been printed and all the input spaces have been left, the method advances to step S395. In step S395 the CPU 225 instructs the motor 229 to move the ink jet print head 212 to the capping stop 222 where the capping stop 222 pushes the slidable capping mechanism 215 to the capping position and instructs the performing of a line feed operation. The method then returns to step S300 where the ink jet print head 212 is moved to the first print position to await the inputting of characters and spaces to be printed on the next line.

It is within the scope of the present invention for:

1) the printer to be any type of non-impact printer, such as an ink jet printer;
2) the input device to be a mouse, a receiving device for receiving character and space data from an external device such as a computer, a microphone and voice recognition circuitry, or any other structure for inputting information into the printer;
3) the slidable capping mechanism to be mounted on a structure separate from the ink jet print head, as long as the slidable capping mechanism can cap the ink jet print head at any point along the guide rail;
4) the tip of the position indicator shown in FIG. 2A to have any type of configuration, as long as it visually indicates the printing and space positions, such as a cylindrical configuration, an ellipsoidal configuration, a spherical configuration, etc;
5) the light emitting element of the position indicator shown in FIG. 2B to be an incandescent element, a laser element, a fluorescent element, or any other type of element that emits light;
6) the light emitting element be an array of light emitting elements, instead of a single element;
7) the uncapping stop 221 and the capping stop 222 to have a shape other than cylindrical, such as spherical, square, rectangular, or oval, as long as they perform the latching and unlatching functions noted above;
8) the uncapping stop 221 and the capping stop 222 to comprise several elements; and 9) the control device to be a microprocessor, a processor, a programmable logic device, an electronically programmable read-only memory, or any other electrical device capable of performing the functions of control device noted above.

The individual components represented by the blocks shown in FIGS. 5A, 5B, and 5C are well known in the printing art and their specific construction and operation is not critical to the invention or the best mode for carrying out the invention. Moreover, the operations discussed in the specification and in shown in FIGS. 6 through 8 can be easily programmed into well known controllers or central processing units by persons of ordinary skill in the art, and since such programming Per se is not part of the invention, no further description thereof is deemed necessary.

While the present invention has been described with respect to what is currently considered to be the preferred embodiments, it is to be understood that the invention is not limited to the disclosed embodiments. To the contrary, the invention is intended to cover various modifications and equivalent arrangements included within the spirit and scope of the appended claims.

I claim:

1. A printing and capping assembly for an ink jet printer, comprising:

a carrier for an ink jet print head, the carrier being configured to mount thereon an ink jet print head comprising a plurality of ink ejection nozzles, said ink jet print head being configured to form characters on a recording medium placed in the ink jet printer by electing ink droplets through said plurality of ink ejection nozzles toward the recording medium, the carrier further being laterally movable in a direction across the recording medium;

a capping mechanism mounted on said carrier for sliding relative to said plurality of ink ejection nozzles between a capped position and an uncapped position and configured to form an air tight seal with said plurality of ejection nozzles when in the capped position;

means for sliding said capping mechanism between the capped and uncapped positions; and input means for inputting a plurality of characters into the printer, wherein the printer is configured to operate in a queue mode in which said carrier moves to a plurality of print positions in response to the inputting of a plurality of characters into the printer and the ink jet print head prints the input characters in response to the inputting of a return into the printer or in response to the printer determining that said carrier reaches a right margin, said capping mechanism being mounted on said carrier separate from said ink jet print head, said assembly further comprising a control device for controlling said sliding means, said control device being configured to control said sliding means to move said capping mechanism to the capped position before said carrier moves to the plurality of print positions and to maintain said capping mechanism in the capped position during the movement of said carrier to the plurality of print positions, and said control device being configured to control said sliding means to slide said capping mechanism to the uncapped position in response to the inputting of a return into the printer or in response to the printer determining that said carrier reaches the right margin.

2. A printing and capping assembly for an ink jet printer, comprising:

a carrier for an ink jet print head, the carrier being configured to mount thereon an ink jet print head comprising a plurality of ink ejection nozzles, said ink jet print head being configured to form characters on a recording medium placed in the ink jet printer by electing ink droplets through said plurality of ink ejection nozzles toward the recording medium, the carrier further being laterally movable in a direction across the recording medium;

a capping mechanism mounted on said carrier for sliding relative to said plurality of ink ejection nozzles between a capped position and an uncapped position and configured to form an air tight seal with said plurality of ejection nozzles when in the capped position;

means for sliding said capping mechanism between the capped and uncapped positions; and input means for inputting a plurality of characters into the printer, wherein said capping mechanism is mounted on said carrier separate from said ink jet print head, wherein the printer is configured to operate in a queue mode in which said carrier moves to a plurality of print positions in response to the inputting of a plurality of characters into the printer and in which said ink jet print head prints the input characters in response to the inputting of a return into the printer or in response to the printer determining that said carrier reaches the right margin, said assembly further comprising a control device for controlling said sliding means and the lateral movement of said carrier, wherein said sliding means comprises:

a capping stop; and an uncapping stop, wherein said capping stop and said uncapping stop are respectively mounted on the opposite walls of the ink jet printer, wherein said uncapping stop is mounted at a position so as to engage said capping mechanism during lateral movement of said capping mechanism to the left between the end of a platen and a stationary capping mechanism, and wherein said capping stop is mounted at a position to engage said capping mechanism during lateral movement of said carrier to its farthest right position, wherein said capping mechanism is slid to the uncapped position when said uncapping stop engages one distal end of said capping mechanism in response to movement of said carrier to said uncapping stop, and wherein said capping mechanism is slid to the capped position when said capping stop engages the other distal end of said capping mechanism in response to movement of said carrier to said capping stop, said control device being configured to control lateral movement of said carrier to move said carrier to said capping stop at which the other distal end of said capping mechanism engages said capping stop to cause sliding of said capping mechanism to the capped position before said carrier moves to the plurality of print positions, said capping mechanism remaining in the capped position during the movement of said carrier to the plurality of print positions in the queue mode, and said control device being configured to control the lateral movement of said carrier to cause said carrier to move to said uncapping stop at which the one distal end of said capping mechanism engages said uncapping stop to cause sliding of said capping mechanism to the uncapped position in response to the inputting of a return into the printer or in response to the printer determining that said carrier reaches the right margin.

3. An ink jet printer, comprising:

a keyboard configured to input characters into said printer;

a laterally extending guide rail;

a carrier slidingly mounted on said guide rail for lateral movement thereon across from a recording medium placed in said printer, said carrier having mounted thereon an ink jet print head comprising a plurality of ink ejection nozzles, said ink jet print head being configured to form the input characters on the recording medium by electing ink droplets through said plurality of ink ejection nozzles toward the recording medium during the lateral movement;

a capping mechanism mounted on said carrier for sliding movement relative to said plurality of ink ejection nozzles between an uncapped position and a capped position, wherein said capping mechanism is configured to form an air tight seal with said plurality of ejection nozzles when in the capped position;

a motor positioned and configured to laterally move said carrier on said guide rail;

means for sliding said capping mechanism between the capped and uncapped positions;

a control device for controlling said motor and said sliding means and for controlling the printing by said ink jet print head; and opposite walls, wherein opposite ends of said guide rail are respectively mounted on said opposite walls of said ink jet printer, wherein said sliding means comprises:

a capping stop; and an uncapping stop, wherein said capping stop and said uncapping stop are respectively mounted on said opposite walls of said ink jet printer, wherein said capping mechanism is slid to the uncapped position when said uncapping stop engages one distal end of said capping mechanism in response to movement of said carrier along said guide rail to a position between the left end of a platen and a stationary capping mechanism to said uncapping stop, wherein said capping mechanism is slid to the capped position when said capping stop engages the other distal end of said capping mechanism in response to movement of said carrier alone said guide rail to said capping stop, and wherein said key board is configured to input a return into said printer, said control device controlling said motor and said ink jet print head to move said carrier from a first print position at a left margin to a plurality of print positions in response to the inputting of a plurality of characters by said keyboard and controlling said ink jet print head to print the input characters in response to the inputting of a return by said keyboard or in response to the inputting by said keyboard of a number of spaces and characters exceeding a predetermined number needed to move said carrier to a right margin, said control device controlling said motor to move said carrier to the right margin in response to the inputting of more than the predetermined number of characters by said keyboard, said control device determining whether said capping mechanism is at the capped position when said carrier is located at the first print position, said control device controlling said motor to move said capping mechanism so that one distal end thereof engages said capping stop to slide said capping mechanism to the capped position in response to said control device determining that said capping mechanism is at the uncapped position when said carrier is located at the first print position, said capping mechanism being maintained at the capped position when said carrier moves from the first print position to the plurality of print positions, said control device controlling said motor to move said carrier to said uncapping stop so that the other distal end of said capping mechanism engages said uncapping stop to slide said capping mechanism to the uncapped position and controlling said carrier to return to the first print position and then controlling said ink jet print head to print the input characters at the plurality of print positions in response to the inputting of a return by said keyboard or in response to the inputting by said keyboard of a number of characters exceeding the predetermined number, and said capping mechanism being maintained at the uncapped position when said ink jet print head prints at the plurality of print positions.

4. An ink jet printer, comprising:

a keyboard configured to input characters into said printer;

a laterally extending guide rail;

a carrier slidingly mounted on said guide rail for lateral movement thereon across from a recording medium placed in said printer, said carrier having mounted thereon an ink jet print head comprising a plurality of ink ejection nozzles, said ink jet print head being configured to form the input characters on the recording medium by electing ink droplets through said plurality of ink ejection nozzles toward the recording medium during the lateral movement;

a capping mechanism mounted on said carrier for sliding movement relative to said plurality of ink ejection nozzles between an uncapped position and a capped position, wherein said capping mechanism is configured to form an air tight seal with said plurality of ejection nozzles when in the capped position;

a motor positioned and configured to laterally move said carrier on said guide rail;

means for sliding said capping mechanism between the capped and uncapped positions; and a control device for controlling said motor and said sliding means and for controlling the printing by said ink jet print head, said keyboard being configured to input a return into said printer, said control device controlling said motor to move said carrier to a right margin in response to the inputting by said keyboard of a number of characters exceeding a predetermined number needed to move said carrier to the right margin, said control device controlling said ink jet print head to print each character as each character is input by said keyboard without waiting for the input of the next character, said control device controlling said sliding means to slide said capping mechanism to the uncapped position in response to the inputting of each character by said keyboard, said control device controlling said sliding means to slide said capping mechanism to the capped position after the printing of each character by said ink jet print head without waiting for the inputting of another character by said keyboard, and said control device controlling said sliding means to slide said capping mechanism to or to maintain said capping mechanism at the capped position in response to the inputting of a return by said keyboard or in response to determining that the number of input characters input by said keyboard exceeds the predetermined number needed to move said carrier to the right margin.

5. An ink jet printer, comprising:

a keyboard configured to input characters into said printer;

a laterally extending guide rail;

a carrier slidingly mounted on said guide rail for lateral movement thereon across from a recording medium placed in said printer, said carrier having mounted thereon an ink jet print head comprising a plurality of ink ejection nozzles, said ink jet print head being configured to form the input characters on the recording medium by electing ink droplets through said plurality of ink ejection nozzles toward the recording medium during the lateral movement;

a capping mechanism mounted on said carrier for sliding movement relative to said plurality of ink ejection nozzles between an uncapped position and a capped position, wherein said capping mechanism is configured to form an air tight seal with said plurality of ejection nozzles when in the capped position;

a motor positioned and configured to laterally move said carrier on said guide rail;

means for sliding said capping mechanism between the capped and uncapped positions; and a control device for controlling said motor and said sliding means and for controlling the printing by said ink jet print head, said keyboard being configured to input a return into said printer, said control device controlling said motor to move said carrier from a first print position at a left margin to a plurality of print positions in response to the inputting of a plurality of characters by said keyboard and controlling said ink jet print head to print the input characters in response to the inputting of a return by said keyboard of a number of characters exceeding a predetermined number needed to move said carrier to the right margin, said control device controlling said motor to move said carrier to the right margin in response to the inputting of more than the predetermined number of characters by said keyboard, said control device controlling said sliding means to move said capping mechanism to or to maintain said capping mechanism at the capped position when said carrier moves to the plurality of print positions without printing, said control device controlling said carrier to return to the first print position and then controlling said ink jet print head to print the input characters at the plurality of print positions after said carrier moves to the plurality of print positions in response to the inputting of a return by said keyboard or in response to the inputting of more than the predetermined number of characters by said keyboard, and said control device controlling said sliding means to slide said capping mechanism to or to maintain said capping mechanism at the uncapped position in response to the inputting of a return by said keyboard or in response to the inputting of more than the predetermined number of characters and before said ink jet print head prints the inputted characters.

6. A method of capping an ink jet print head of an ink jet printer comprising the steps of:

moving a carrier along a guide rail, the carrier separately supporting the ink jet print head and a capping mechanism; and sliding the capping mechanism relative to a plurality of ink ejection nozzles of the ink jet print head between capped and uncapped positions, wherein in the capped position the capping mechanism forms an air tight seal with the plurality of ink ejection nozzles, wherein said sliding step comprises the steps of:

moving the carrier to one end of the guide rail to a capping stop so that one distal end of the capping mechanism engages the capping stop to slide the capping mechanism from the uncapped position to the capped position; and moving the carrier to the other end of the guide rail to a position between the left end of a platen and a stationary capping mechanism to an uncapping stop so that the other distal end of the capping mechanism engages the uncapping stop to slide the capping mechanism from the capped position to the uncapped position, wherein the printer is configured to operate in a queue mode in which the carrier moves to a plurality of print positions in response to the inputting of a plurality of characters into the printer and in which the ink jet print head prints the input characters in response to the inputting of a return into the printer or in response to the printer determining that the carrier reaches the right margin, wherein said step of moving the carrier to one end of guide rail to the capping stop is performed in response to turning on the printer, moving said carrier to the first print position, and determining that said capping mechanism is in the uncapped position, or in response to the completion of printing of the input characters, said method further comprising the step of maintaining the capping mechanism in the capped position during the movement of the carrier to the plurality of print positions in the queue mode, and wherein said step of moving the carrier to the other end of the guide rail to an uncapping stop is performed in response to the inputting of a return into the printer or in response to the printer determining that the carrier reaches the right margin.

7. A method of capping an ink jet print head of an ink jet printer comprising the steps of:

moving a carrier along a guide rail, the carrier separately supporting the ink jet print head and a capping mechanism; and sliding the capping mechanism relative to a plurality of ink ejection nozzles of the ink jet print head between capped and uncapped positions, wherein in the capped position the capping mechanism forms an air tight seal with the plurality of ink ejection nozzles, wherein the printer operates in a queue mode in which the carrier moves to a plurality of print positions in response to the inputting of a plurality of characters into the printer and in which said ink jet print head prints the input characters in response to the inputting of a return into the printer or in response to the printer determining that the carrier reaches a right margin, and wherein said sliding step comprises the steps of:

sliding the capping mechanism to the capped position or maintaining the capping mechanism at the capped position during the movement of the carrier to the plurality of print positions in the queue mode; and sliding the capping mechanism to the uncapped position in response to the inputting of a return into the printer or in response to the printer determining that the carrier reaches the right margin.

8. A method of printing with an ink jet print head of an ink net printer and of capping the ink jet print head, comprising the steps of:

moving a carrier along a guide rail, the carrier having mounted thereon the ink jet print head, a capping mechanism, and means for sliding the capping mechanism between a capped and an uncapped position, and while the carrier is moving along the guide rail printing or refraining from printing with the ink jet print head;

sliding the capping mechanism relative to a plurality of ink ejection nozzles of the ink jet print head from the uncapped position to the capped position or maintaining the capping mechanism at the capped position during at least part of the time when the ink jet print head refrains from printing, and forming an air tight seal between the plurality of ink ejection nozzles and the capping mechanism when the capping mechanism is in the capped position;

sliding the capping mechanism relative to the plurality of ink ejection nozzles from the capped position to the uncapped position to permit printing by the ink jet print head;

positioning the carrier at a first print position at a left margin;

determining whether the capping mechanism is at the capped position when the carrier is located at the first print position in said positioning step;

moving the carrier along the guide rail to one end thereof so that a distal end of the capping mechanism engages a capping stop mounted on a wall of the printer to which the one end of the guide rail is attached, to slide the capping mechanism to the capped position in response to said determining step determining that the capping mechanism is at the uncapped position when said carrier is located at the first print position, and moving the carrier along the guide rail;

inputting a plurality of characters into the printer with a keyboard configured to input a return into the printer;

moving the carrier to the first print position and then to a plurality of print positions in response to the inputting of the plurality of characters in said inputting step;

maintaining the capping mechanism at the capped position when the carrier moves from the first print position to the plurality of print positions;

moving the carrier along the guide rail to the other end thereof so that the other distal end of the capping mechanism engages an uncapping stop mounted on a wall of the printer to which the other end of the guide rail is attached, to slide the capping mechanism to the uncapped position, and moving the carrier along the guide rail;

returning the carrier to the first print position and then printing the input characters at the plurality of print positions in response to the inputting of a return by the keyboard or in response to said inputting step inputting a number of characters exceeding a predetermined number needed to move the carrier to a right margin; and maintaining the capping mechanism at the uncapped position while the ink jet print head prints at the plurality of print positions.

9. A method of printing with an ink jet print head of an ink jet printer and of capping the ink jet print head, comprising:

moving a carrier along a guide rail, the carrier having mounted thereon the ink jet print head, a capping mechanism, and means for sliding the capping mechanism between a capped and an uncapped position, and while the carrier is moving along the guide rail printing or refraining from printing with the ink jet print head;

sliding the capping mechanism relative to a plurality of ink ejection nozzles of the ink jet print head from the uncapped position to the capped position or maintaining the capping mechanism at the capped position during at least part of the time when the ink jet print head refrains from printing, and forming an air tight seal between the plurality of ink ejection nozzles and the capping mechanism when the capping mechanism is in the capped position;

sliding the capping mechanism relative to the plurality of ink ejection nozzles from the capped position to the uncapped position to permit printing by the ink jet print head;

a first inputting step of inputting a character into the printer with a keyboard configured to input a return into the printer;

a first sliding step of sliding the capping mechanism from the capped position to the uncapped position, if the capping mechanism is in the capped position, after the character is input in said first inputting step without waiting for the input of another character;

a printing step of printing the input character with the ink jet print head without waiting for the input of another character;

a second sliding step of sliding the capping mechanism from the uncapped position to the capped position after said printing step;

a second inputting step of inputting a plurality of characters into said printer;

repeating said first sliding step, said printing step, and said second sliding step after each of the plurality of characters are input and before a next character is input in said second inputting step;

a third sliding step of sliding the capping mechanism to the capped position if the capping mechanism is in the uncapped position or maintaining the capping mechanism at the capped position if the capping mechanism is already at the capped position in response to the inputting of a return by the keyboard or if the number of the plurality of characters input in said second inputting step exceeds a predetermined number needed to move the carrier to a right margin; and a step of moving the carrier to the first print position after said third sliding step.

10. A method of printing with an ink jet print head of an ink jet printer and of capping the ink jet print head, comprising the steps of:

moving a carrier alone a guide rail, the carrier having mounted thereon the ink jet print head, a capping mechanism, and means for sliding the capping mechanism between a capped and an uncapped position, and while the carrier is moving alone the guide rail printing or refraining from printing with the ink jet print head;

sliding the capping mechanism relative to a plurality of ink ejection nozzles of the ink jet print head from the uncapped position to the capped position or maintaining the capping mechanism at the capped position during at least part of the time when the ink jet print head refrains from printing, and forming an air tight seal between the plurality of ink ejection nozzles and the capping mechanism when the capping mechanism is in the capped position;

sliding the capping mechanism relative to the plurality of ink ejection nozzles from the capped position to the uncapped position to permit printing by the ink jet print head;

positioning the carrier at a first print position at a left margin of the printer;

inputting a plurality of characters into the printer with a keyboard configured to input a return into the printer;

moving the carrier from the first print position to a plurality of print positions in response to the inputting of the plurality of characters in said inputting step;

sliding the capping mechanism to the capped position or maintaining the capping mechanism at the capped position while the carrier moves to the plurality of print position in said moving step;

returning the carrier to the first print position and sliding the capping mechanism to the uncapped position in response to the inputting of a return by the keyboard or if the carrier has moved to the right margin in said moving step; and printing the input characters at the first print position and at the plurality of print positions.

* * * * *

UNITED STATES PATENT AND TRADEMARK OFFICE

CERTIFICATE OF CORRECTION

PATENT NO. : 5,867,186

DATED : February 2, 1999

INVENTORS : Theofanis P. Teazis

It is certified that error appears in the above-identified patent and that said Letters Patent is hereby corrected as shown below:

COLUMN 12

Line 54, "etc;" should read --etc.;--.

COLUMN 13

Line 11, "in" (first occurrence) should read --as--;
Line 14, "Per se" should read --per se--; and
Line 31, "electing" should read --ejecting--.

COLUMN 14

Line 8, "electing" should read --ejecting--.

COLUMN 15

Line 18, "electing" should read --ejecting--; and
Line 53, "alone" should read --along--.

COLUMN 16

Line 40, "electing" should read --ejecting--.

COLUMN 19

Line 21, "net" should read --jet--.

UNITED STATES PATENT AND TRADEMARK OFFICE

CERTIFICATE OF CORRECTION

PATENT NO. : 5,867,186

DATED : February 2, 1999

INVENTORS : Theofanis P. Teazis

It is certified that error appears in the above-identified patent and that said Letters Patent is hereby corrected as shown below:

COLUMN 21

Line 5, "alone" should read --along--; and
Line 9, "alone" should read --along--.

Signed and Sealed this

Seventh Day of March, 2000

*Attest:*

*Attesting Officer*

Q. TODD DICKINSON

*Commissioner of Patents and Trademarks*